United States Patent [19]

Baloga et al.

[11] Patent Number: 4,856,242

[45] **Date of Patent: * Aug. 15, 1989**

[54] SPACE PARTITION ARRANGEMENT

[75] Inventors: Mark A. Baloga, Grand Rapids, Mich.; Edmond Trimborn, Wasselonne, France; Philippe Fussler, Strasbourg, France

[73] Assignee: Steelcase Inc., Grand Rapids, Mich.

[ * ] Notice: The portion of the term of this patent subsequent to Dec. 29, 2004 has been disclaimed.

[21] Appl. No.: 134,701

[22] Filed: Dec. 18, 1987

Related U.S. Application Data

[63] Continuation-in-part of Ser. No. 680,282, Dec. 10, 1984, Pat. No. 4,715,154.

[51] Int. Cl.[4] ..... E04H 1/00

[52] U.S. Cl. ..... 52/239; 52/79.1; D6/332

[58] Field of Search ..... 52/27–29, 52/69–70, 79.1, 79.5, 79.7, 143, 220, 238.1, 239, 22; 160/135, 351; D25/4, 16, 58; D26/332, 396, 422, 423

[56] References Cited

U.S. PATENT DOCUMENTS

| | | | |
|---|---|---|---|
| De. 101,887 | 11/1936 | Reynolds | D25/16 |
| De. 115,144 | 6/1939 | Deravin | D25/4 |
| D. 147,386 | 8/1947 | Thomas . | |
| D. 208,296 | 8/1967 | Bartles et al. . | |
| De. 288,613 | 3/1987 | James et al. | D25/16 X |
| 2,089,059 | 8/1937 | Harley . | |
| 3,063,496 | 11/1976 | Kessler | D25/16 X |
| 3,564,787 | 2/1971 | Sherman . | |
| 3,601,031 | 8/1971 | Abel | D25/58 X |
| 3,683,100 | 8/1972 | Deal et al. . | |
| 3,719,768 | 3/1973 | Jonsson . | |
| 3,774,357 | 11/1973 | Moore . | |
| 3,792,558 | 2/1974 | Berce et al. . | |
| 3,802,133 | 4/1974 | Gregory . | |
| 3,807,105 | 4/1974 | Rudkin, Jr. et al. . | |
| 3,828,492 | 8/1974 | Schliemann et al. . | |
| 3,838,545 | 10/1974 | Kump . | |
| 3,841,037 | 10/1974 | Clark . | |
| 3,848,375 | 11/1974 | White . | |
| 3,865,429 | 2/1975 | Barker . | |
| 3,871,146 | 3/1975 | Hamy . | |
| 3,905,167 | 9/1975 | Watkins et al. . | |
| 3,916,972 | 11/1975 | Breiner . | |
| 3,921,348 | 11/1975 | Kurzen . | |
| 3,984,621 | 10/1976 | Propst . | |
| 4,010,579 | 3/1977 | Galvagni . | |
| 4,037,380 | 7/1927 | Pollock . | |
| 4,038,796 | 8/1977 | Eckel . | |
| 4,060,294 | 11/1977 | Haworth et al. . | |
| 4,124,964 | 11/1978 | Juriss et al. . | |
| 4,181,095 | 1/1980 | Sylogye . | |
| 4,228,623 | 10/1980 | Menosso . | |
| 4,351,475 | 9/1982 | Hudson . | |
| 4,372,087 | 2/1983 | Kump . | |
| 4,715,154 | 12/1987 | Baloga | 52/239 |

*Primary Examiner*—Carl D. Friedman

*Attorney, Agent, or Firm*—Price, Heneveld, Cooper, DeWitt & Litton

[57] ABSTRACT

A unique space partition arrangement creates either private, three-dimensional work stations or rooms, or a covered entryway for open office space. The module provides workers with the sensation of having their very own private room, even within extremely large, open office plans, thereby alleviating "close work" fatigue. The office module includes two sidewal panels which are positioned in a generally vertical, oppositely facing orientation, and are supported in a spaced apart and freestanding condition. A ceiling has opposite end edges connected with the upper edges of the sidewall panels, and spans the sidewall panels. The office module has a height and girth which are substantially smaller that the respective dimensions of the open office space, so that the office module can be easily transported and placed at any desired location within the room. The ceiling is positioned well above the head height of the average user, and forms a canopy, which in conjunction with the sidewall panels, defines an unobstructed, three-dimensional work station, that has a degree of privacy for more efficient work performance, without evoking a sense of claustrophobia.

17 Claims, 10 Drawing Sheets

SPACE PARTITION ARRANGEMENT

CROSS-REFERENCE TO RELATED APPLICATIONS

The present application is a continuation-in-part of co-pending patent application Ser. No. 680,282, filed Dec. 10, 1984, entitled SPACE PARTITION MODULE, now U.S. Pat. No. 4,715,754, which is hereby incorporated by reference.

BACKGROUND OF THE INVENTION

The present invention relates to partition arrangements for open office space.

Heretofore, various types of partition arrangements have been used to section off selected areas of floor space in an open office layout. Typically, partition panels are interconnected to form a series of walls that define separate cubicles. In general, wall partitions do not extend to the ceiling, but have a height that is slightly above the line of sight of the average individual, so that each office cubicle has some degree of privacy. However, since the partitions do not extend to the ceiling, the sense of "privacy" is greatly reduced.

The common ceiling that is shared by prior office cubicles normally contains all of the room's overhead lighting, as well as the room's heating and cooling. Hence, a flickering overhead light, or a whistling air duct will be sensed by the workers in many, if not all of the office cubicles in the room. Such factors do not support a feeling of privacy within the office cubicle.

The large gap or space which normally exists between the top of the wall partitions and the ceiling of the room permits noises, odors, and other distracting stimuli to be readily transmitted between neighboring office cubicles. Also, an average height worker can look over the typical, sixty-five inch wall partitions, and peer into any particular office cubicle, without going through the designated entrance. Those workers that are above average height have no trouble whatsoever in looking over sixty-five inch wall partitions, and furthermore, their heads are readily visible to the occupants of the office cubicles as these individuals pass by.

In addition to those problems discussed above, the walls of prior office cubicles are typically shared by adjacent work stations, so that the sound and movement of the occupants are readily transmitted to neighboring offices. All of these factors create distractions that greatly decrease the productivity of the office worker, and reduce the degree of privacy which the office worker experiences.

Recent studies have concluded that the psychological effect which the office environment has upon workers is very closely related to the worker's level of productivity. Hence, those negative psychological stimuli in the work environment which are discussed above, such as unexpected distractions, noise and the lack of privacy, result in inefficient work, and cause ascertainable economic losses to the employer.

The renovation of older buildings into modern, open office plans also presents some rather difficult and specialized problems. Initially, it is very difficult to create private office spaces in older buildings due to high ceilings, poor air circulation, and the general lack of modern utilities. Also, the proliferation of electronic office machinery, telecommunications and computerization, has greatly increased the demand for electrical power, proper lighting and temperature control in the building.

As a result, office renovations almost always require that additional electrical power, telephone lines, lighting and air-conditioning facilities be added to upgrade older office areas. The retrofitting and installation of such new utilities can be very costly and difficult, particularly without totally gutting the building structure.

SUMMARY OF THE INVENTION

One aspect of the present invention is to provide a unique space partition module that creates private, three-dimensional work stations within an open office plan. The office module includes two sidewall panels, which are positioned in a generally vertical, oppositely facing orientation, and are supported in a spaced apart, free-standing condition, i.e., without attachment to the room ceiling or walls. The office module is also preferably self-supporting, so that it need not be fastened to the floor of the building. A ceiling has opposite end edges connected with the upper edges of the sidewall panels, and spans between them without any intermediate support. The office module has a height and girth which are substantially smaller than the respective dimensions of the open office space which is to be divided, so that the office module can be easily transported and placed in any desired location within the room. The ceiling is located well above the head height of the average worker, and forms a canopy, which in conjunction with the sidewall panels, defines a three-dimensional work station that has a degree of privacy for more efficient work performance, without evoking a sense of claustrophobia.

Preferably, the office module also includes a window in the ceiling to transmit overhead light and air into the interior of the module, as well as cove panels that interconnect the side panels and the ceiling, and are inclined inwardly to provide a smooth transition therebetween. A privacy panel may be connected with a side edge of one of the sidewall panels to partially or completely close off one of the open ends of the office module to create a private work area, and also to provide lateral stability. A generally L-shaped reception area panel may also be connected with a side edge of one of the sidewall panels to provide extra stability to the module, and also to form a two-dimensional, semi-private reception area adjacent to the three-dimensional work station.

Another aspect of the present invention is to provide a space partition arrangement which can be used either as a module to create a private, three-dimensional work station or as a covered entryway to a partitioned, open office area.

A principal object of the present invention is to provide a unique space partition arrangement that is particularly designed for use in open office layouts. The space partition arrangement can be used to form either an office module for private work stations, or a covered common entryway for a partitioned, open office area. When used as an office module, the space partition arrangement gives workers the sensation of having their very own private room, without causing claustrophobia, thereby alleviating "close work" fatigue. The office module is a sturdy, freestanding and self-supporting unit, and can be easily positioned at any desired location within the room. Since each office module has its own walls and ceiling, the transmission of sound, light, odors and other distracting stimuli between neighboring offices can be greatly reduced. The modules have maximum sound absorption in a particular direction or orientation, so that multiple modules can be arranged to achieve the desired degree of audio isolation. Sound masking may also be provided in each module to alleviate the disruptive effect of external conversations, and other noises. Each office module can have its own controlled lighting to suit the specific task being performed in the work station. Furthermore, a greater degree of air circulation and temperature control can be achieved in each separate work station. The present invention is particularly adapted for renovating old buildings, since utilities such as power lines, telephone lines, heating and cooling facilities, and the like can be brought to the work stations through the sidewalls and ceiling of the module, thereby avoiding the need to remove and/or replace existing building facilities. The office module is also modular in construction, so that a plurality of units can be interconnected to form an integrated office system in which the various modules are mutually oriented in a predetermined pattern in accordance with the task to be performed, so as to achieve maximum work efficiency.

When used as a covered entryway, the space partition arrangement assists in dividing the open office area into distinct sections, so as to better define different working groups, or to segregate common areas from private office areas, or the like.

These and other features, advantages, and objects of the present invention will be further understood and appreciated by those skilled in the art by reference to the following written specification, claims and appended drawings.

DETAILED DESCRIPTION OF THE PREFERRED EMBODIMENTS

Figure 1:
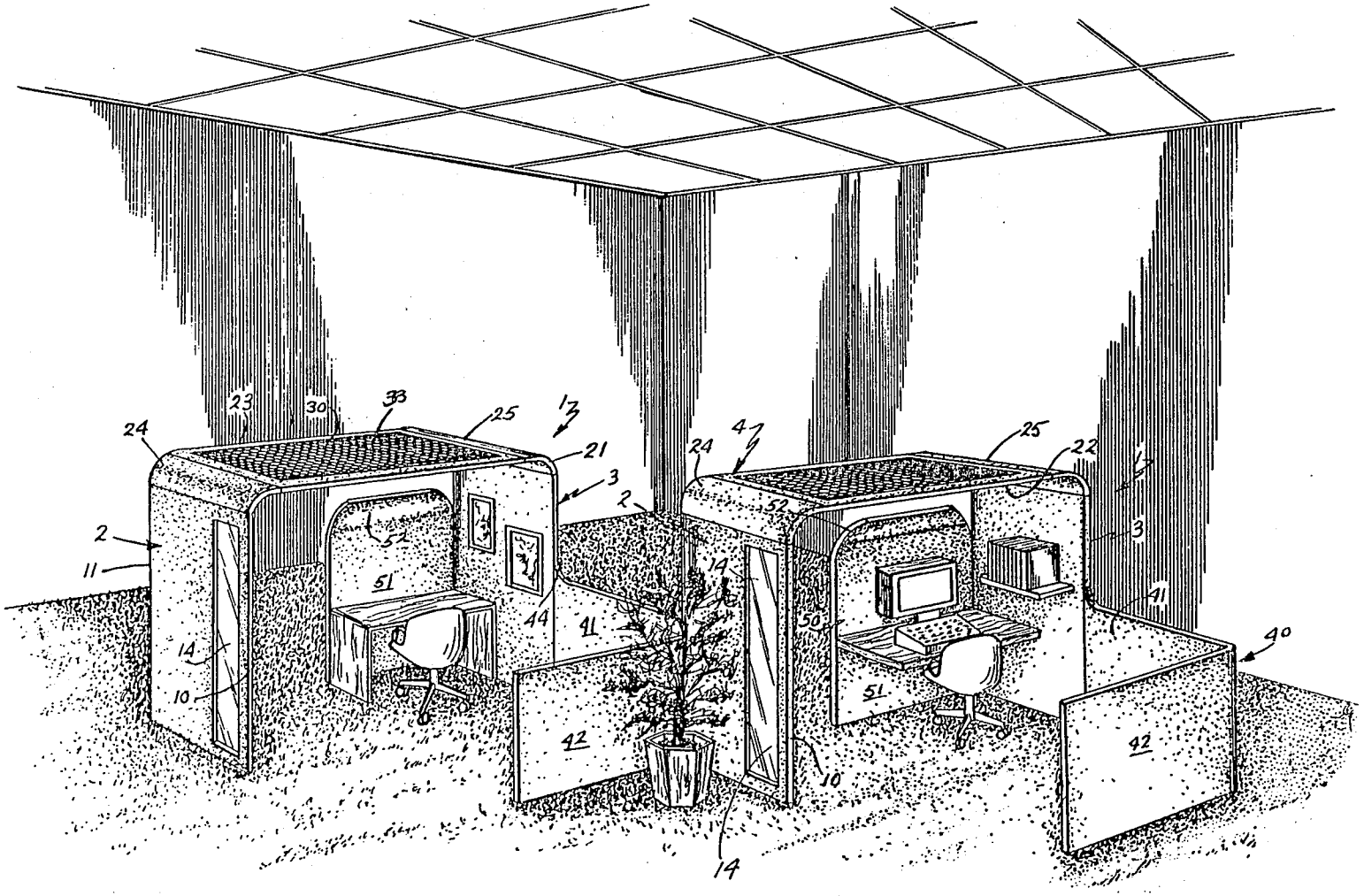
FIG. 1 is a perspective view of a space partition arrangement embodying the present invention, particularly showing two space partition modules.
Figure 2:
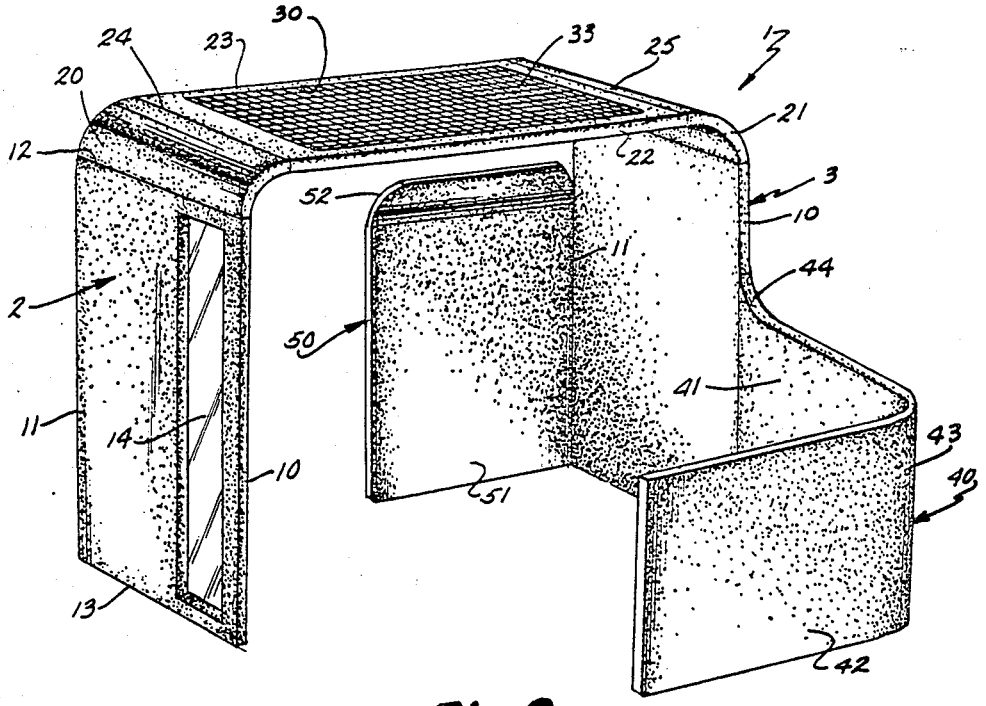
FIG. 2 is a perspective view of a single space partition module embodying the present invention.
Figure 3:
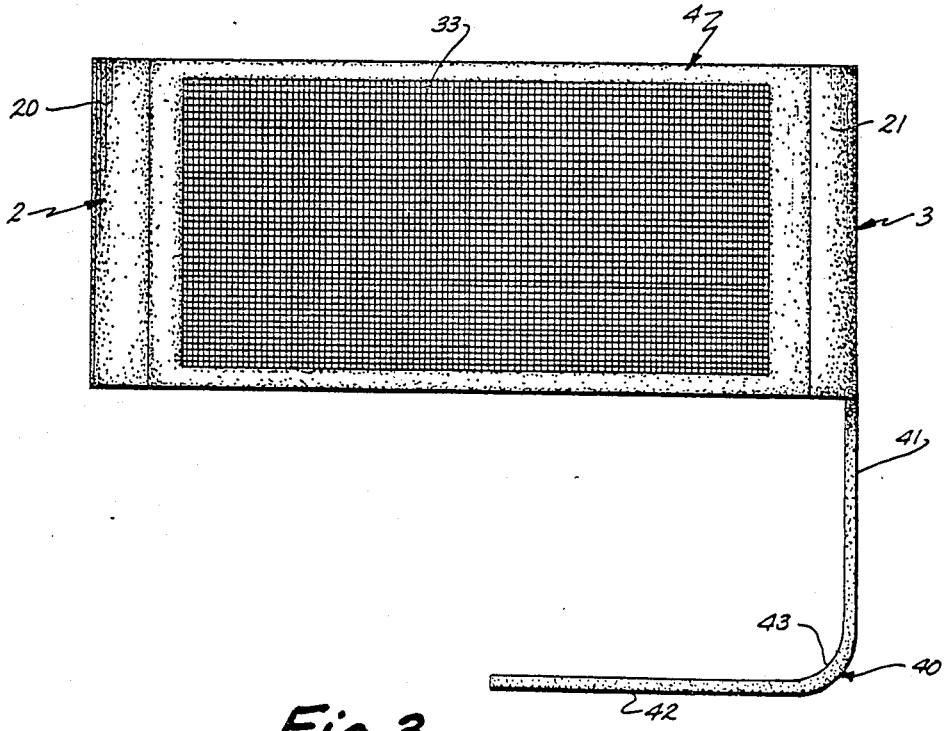
FIG. 3 is a top plan view of the space partition module shown in FIG. 2.

For purposes of description herein, the terms "upper," "lower," "right," "left," "rear," "front," "back," "vertical," "horizontal," and derivatives thereof shall relate to the invention as oriented in FIGS. 1–4. However, it is to be understood that the invention may assume various alternative orientations, except where expressly specified to the contrary.

The reference numeral 1 (FIG. 1) generally designates a space partition arrangement embodying the present invention. In FIGS. 1–18, space partition arrangement 1 is in the form of an office module, which includes two sidewall panels 2 and 3 positioned in a generally vertical, oppositely facing orientation, and supported in a mutually spaced apart and freestanding condition. A ceiling 4 has opposite end edges connected with the upper edges of sidewall panels 2 and 3, and extends therebetween without any intermediate support. Office module 1 has a height and a girth which are substantially smaller than the respective dimensions of the open office space, so that office module 1 can be easily transported and placed at any desired location within the room. Ceiling 4 is located well above the head height of the average worker, and forms a canopy, which in conjunction with sidewall panels 2 and 3, defines a three-dimensional work station that has a degree of privacy for more efficient work performance, without evoking a sense of claustrophobia.

Sidewall panels 2 and 3 (FIGS. 2 and 3) are flat, have a generally rectangular plan shape, and include side edges 10 and 11, and upper and lower edges 12 and 13 respectively. In this example, the lower edges 13 of sidewall panels 2 and 3 abut the floor of the open office space, and support the office module 1 thereon. Sidewall panels 2 and 3 are held erect and self-supported or freestanding through their connection to ceiling panel 4. Laterally extending feet (not shown) may be attached to sidewall panels 2 and 3 to provide additional stability. Sidewall panel 2 includes a rectangularly shaped aperture or window 14 that is designed to provide light and visual communication between adjacent offices, when such communication is desired. It is to be understood that window 14 may assume different shapes, sizes, and positions, and that the illustrated embodiment is merely exemplary of one suitable window configuration. The longitudinal axis of the illustrated window 14 is oriented in a vertical direction. Window 14 is positioned adjacent to the forward edge 10 of sidewall panel 2, and may include a panel of glass, or other suitable transparent material, to reduce the transmission of noise and odors between offices. In this embodiment of the present invention, sidewall panels 2 and 3 preferably have a height and width in the range of 5–7 feet. One particular example of sidewall panels 2 and 3 has a height of approximately 75 inches, and a width of approximately 75 inches. However, it is to be understood that all of the specific dimensions, shapes and proportions set forth herein are merely exemplary, and are not in any way intended to be limiting of the present invention, except as may be expressly set forth in the appended claims. The present invention contemplates that office module 1, and the various constituent elements thereof, may assume many different shapes, sizes and orientations.

The ceiling 4 illustrated in FIGS. 1–13 is in the nature of a panel, having a generally rectangular plan configuration, with opposite side edges 22 and 23, and end edges 24 and 25, and is attached to sidewall panels 2 and 3 by a pair of cove panels 20 and 21. Cove panels 20 and 21 have their opposite side edges connected with the upper edges 12 of sidewall panels 2 and 3, and the end edges 24 and 25 of ceiling panel 4, and are inclined inwardly towards ceiling panel 4. In the illustrated example, cove panels 20 and 21 have a generally arcuate, end elevational shape, in the nature of one quarter of a cylinder. Cove panels 20 and 21 provide a smooth transition between sidewall panels 2 and 3 and ceiling panel 4, and assist in creating a canopy effect for office module 1. One particular example of cove panels 20 and 21 has a length of approximately 75 inches, and a radius of approximately 16 inches.

Ceiling panel 4 (FIGS. 2 and 3) is flat, and preferably includes a central aperture or window 30 through which air and light in the open office space can be transmitted into the interior of the office module 1. The illustrated ceiling window 30 has a generally rectangular plan configuration, and is rather large, encompassing a major portion of the entire surface of ceiling panel 4. Ceiling window 30 also permits overhead fire sprinkling systems in the room to introduce water to the interior of office module 1 in the event of a fire. One particular example of ceiling panel 4 has a width of approximately 75 inches, and a length of approximately 88 inches.

Various means to control the light in the interior of office module 1 can be mounted in ceiling window 30. In the examples illustrated in FIGS. 1–5, a grid-like light deflector panel 33 is mounted in the window 30 of the ceiling panel 4. Light deflector 33 is of the open grid type so that light, water and air can pass freely therethrough. Light deflector 33 is designed to diffuse incoming overhead light to alleviate shadows and/or any glare that might appear on work surfaces, video display tubes (VDT), and the like. An additional light source, such as the light units 34 illustrated in FIGS. 8–10, can also be mounted in window 30 to provide an additional source of light for office module 1.

Office module 1 preferably includes at least one laterally extending panel connected with one of the sidewall panels 2 and 3, in the nature of an outrigger panel, to improve the lateral stability of the module. The outrigger panel is positioned in a non-parallel relationship with the sidewall panels 2 and 3, and has a lower edge which is supported on the floor of the building. Two different types of outrigger panels are disclosed in the present application, and comprise a reception area panel 40 (FIG. 1) and a privacy panel 50.

Reception area panel 40 is attached to a side edge 10 or 11 of one of sidewall panels 2 and 3. In the office module illustrated in FIGS. 1–11, reception area panel 40 has a generally L-shaped plan configuration. Reception area panel 40 is connected to the forward edge 10 of sidewall panel 3, and provides extra lateral stability to the office module 1, and also forms a two-dimensional, semi-private reception area, similar to a curtilage, adjacent to the three-dimensional work station. Reception area panel 40 includes a flat side section 41, a flat end section 42, and an arcuate intermediate section 43. Reception area panel 40 is generally chest to shoulder high, and in this example, includes an arcuate, upwardly oriented transition section 44 that blends smoothly into the forward edge 10 of sidewall panel 3. One particular reception area panel 40 has a height of approximately 55 inches, and side section 41 has a length of around 75 inches, with end section 42 approximately 60–90 inches long.

In the example illustrated in FIGS. 1–11, a privacy panel 50 is attached to the rear edge 11 of sidewall panel 3, and extends laterally across the rear end of office module 1 to form a closed corner area. The illustrated privacy panel 50 extends approximately halfway across the open, rear end of office module 1, and has a height approximately three-quarters of the height of the office module. Privacy panel 50 has a flat lower section 51, and an arcuate, inwardly inclined upper section 52. One particular privacy panel 50 has a width of approximately 60 inches, and a height of around 71 inches. Privacy panel 50 may have different widths and heights, and may extend any length across the open, rear end of office module 1, including completely across the open end to maximize privacy.

Office module 1 preferably includes acoustical characteristics which provide a very quiet, soundproof work space. In this example, sidewall panels 2 and 3, cove panels 20 and 21, ceiling panel 4, reception area panel 40, and privacy panel 50 each have a hard exterior surface that reflects ambient sounds emanating from the open office, and a soft, sound absorbent interior surface that absorbs sound, and abates the transmission of noise generated from within the office module to neighboring work stations.

Figure 6:
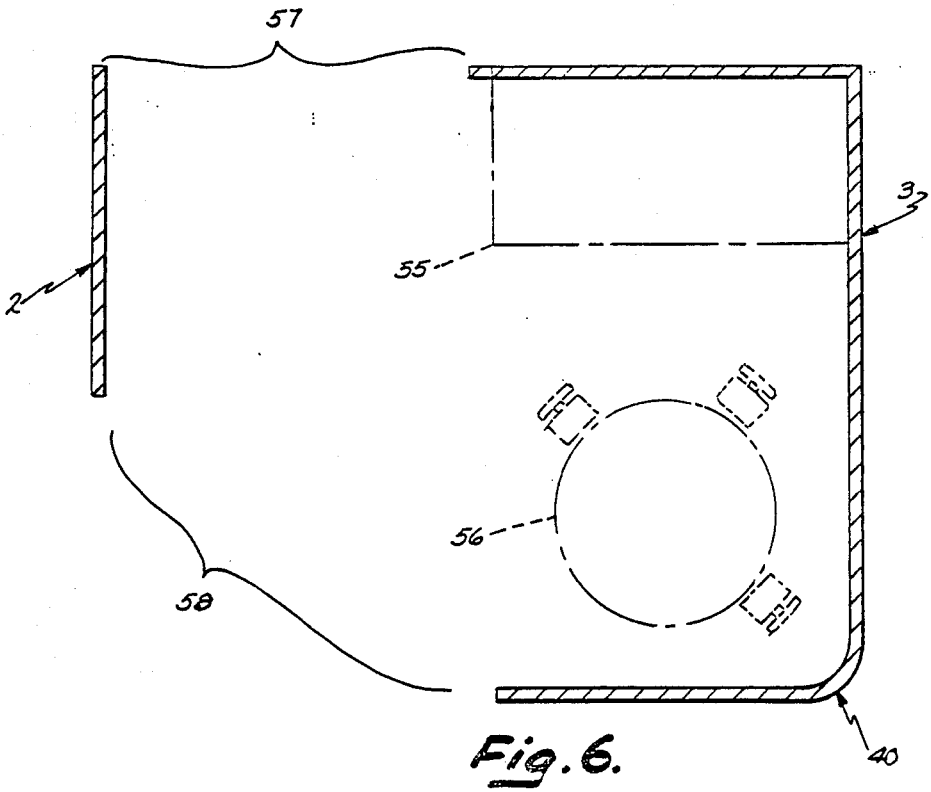
FIG. 6 is a horizontal, cross-sectional view of the space partition module, taken along line VI—VI of FIG. 4, wherein a desk area and reception area are shown in broken lines.

The area at which privacy panel 50 abuts sidewall panel 3 provides an excellent area to locate a work surface, such as the area shown in broken lines in FIG. 6, and noted by the reference numeral 55. The forward right-hand corner of work surface 55 provides a very good area in which to locate a telephone. This area is in the nature of a phone booth, and provides improved privacy, and reduced sound transmission. Reception area panel 40 creates a semiprivate reception area, which is also shown in broken lines in FIG. 6, and is noted by the reference numeral 56. With reference again to FIG. 6, office module 1 includes two entrance and exit areas 57 and 58 through which workers can access the work station.

Figure 7:
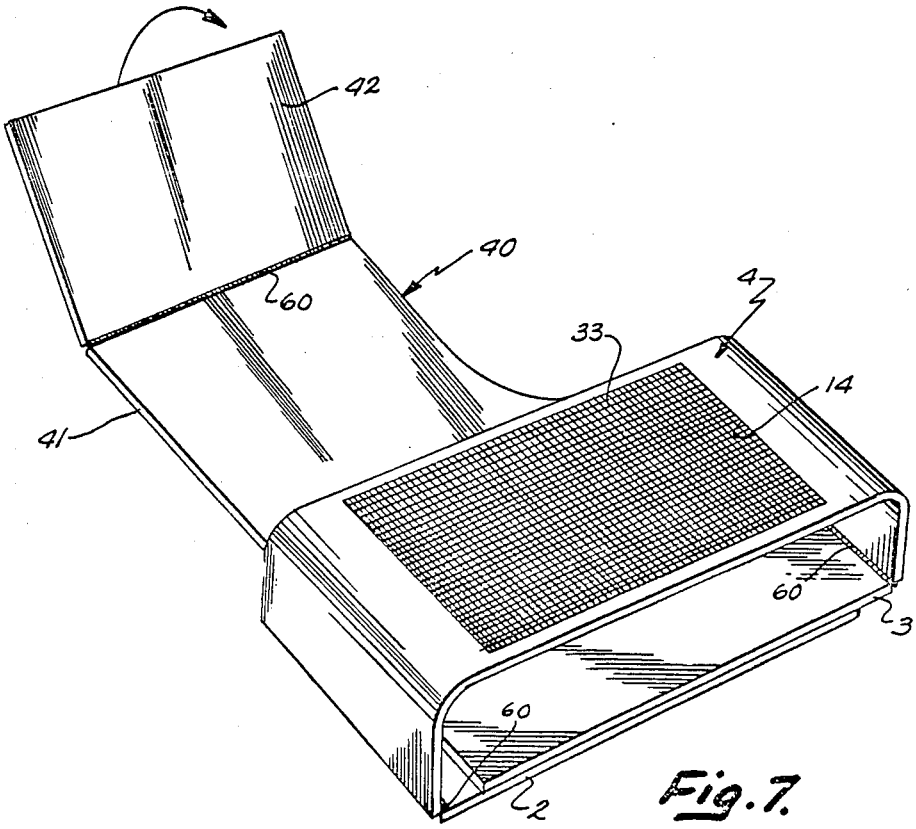
FIG. 7 is a perspective view of the space partition module, shown in a partially folded up condition for storage and/or transportation.
Figure 8:
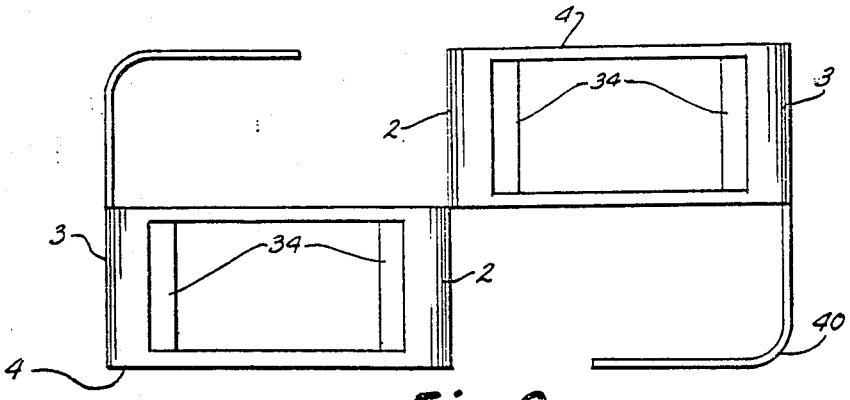
FIG. 8 is a top plan view of two space partition modules, shown in a slightly reduced scale, and in a diagonally arranged configuration.

As best illustrated in FIG. 7, the interconnection of the adjacent panel portions of office module 1 are preferably achieved by hinges 60, which permit the unit to be folded up for storage and/or transportation.

Figure 4:
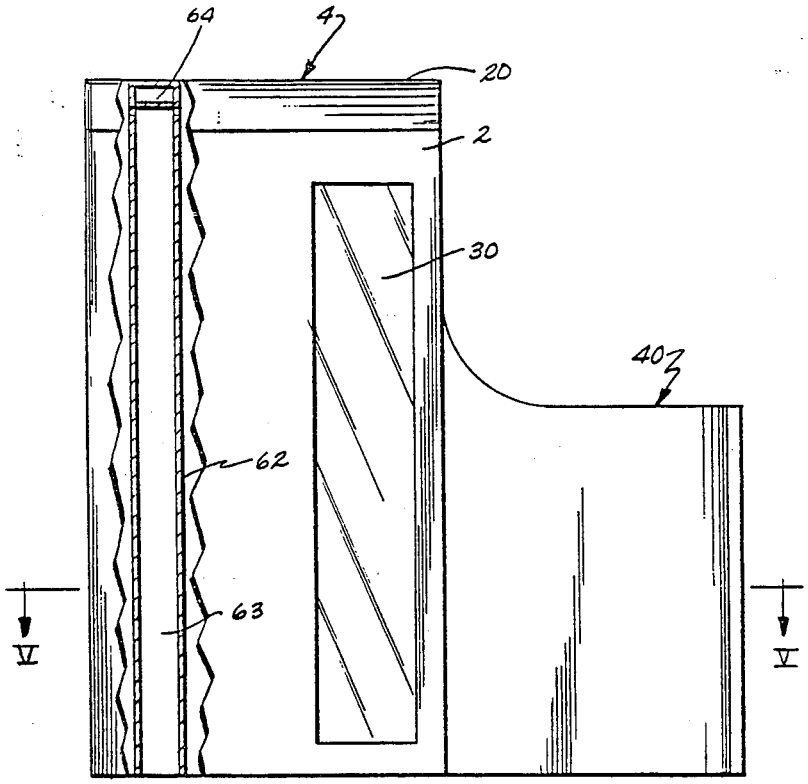
FIG. 4 is a side elevational view of the space partition module shown in FIG. 2.
Figure 5:
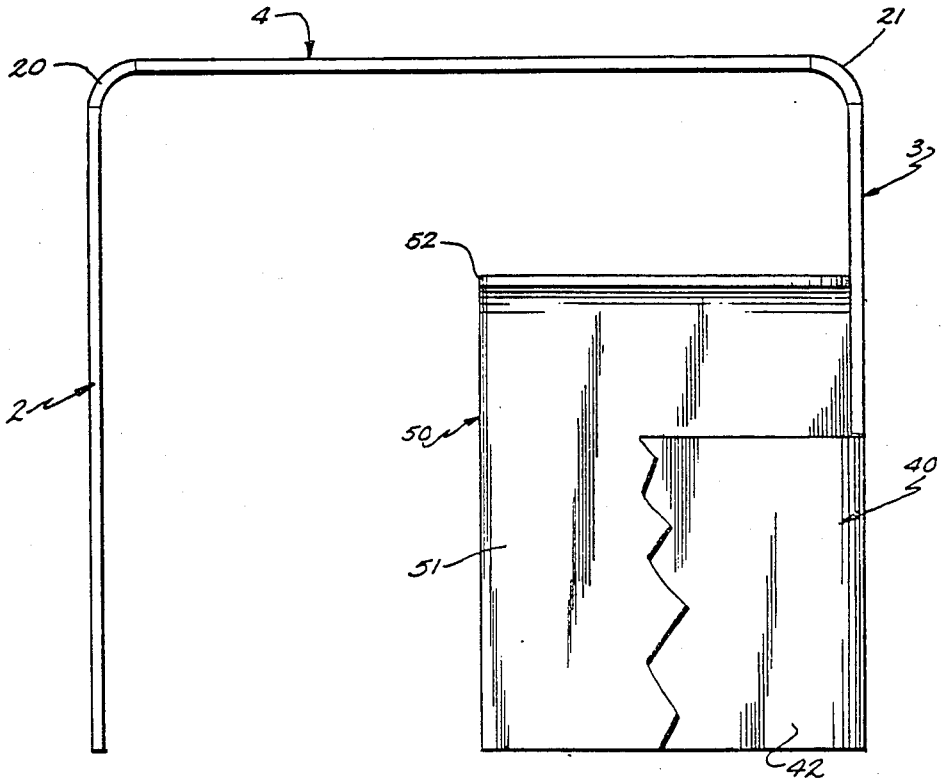
FIG. 5 is a front elevational view of the space partition module shown in FIG. 2, wherein a portion of a forward, reception area panel has been broken away to reveal internal construction.

The office module 1 illustrated in FIG. 4 includes a utility duct 62, which can be used to provide electrical power, telephone lines, air conditioning, and other utilities to the office module. In this example, utility duct 62 has a generally vertical section 63 which extends through the interior of sidewall panel 2 and cove panel 20, and a generally horizontal section 64 which extends through the interior of ceiling panel 4. Preferably, the opposite sidewall and cove panels 3 and 21 have an identical vertical duct section (not shown) which communicate with the ceiling duct 64, so as to form a continuous utility duct which can be used not only to service office module 1, but also to connect the utilities with adjacent office modules. Utility duct 62 can supply conditioned or recirculated air to a register (not shown) in ceiling panel 4, so that the work station has independent temperature control. An auxiliary air-conditioner unit (not shown) can also be mounted in ceiling panel 4 to provide extra cooling for sensitive machinery, such as computers, and the like.

The flowing, curved lines of office module 1 are achieved through the upper section 52 of privacy panel 50, the curved corner portion 43 of reception area panel 40, and cove panels 20 and 21. This arcuate overall shape makes office module 1 aesthetically pleasing, ad gives the office module a sense of roominess far beyond its actual dimensions.

Figure 9:
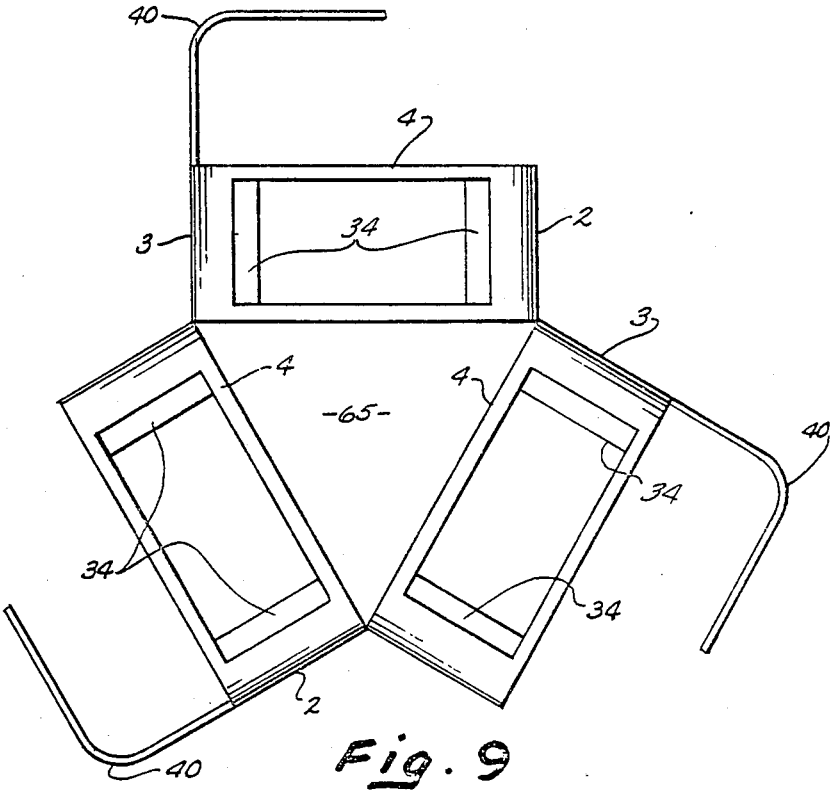
FIG. 9 is a top plan view of three space partition modules, shown in a slightly reduced scale, and arranged in a triangular configuration.
Figure 10:
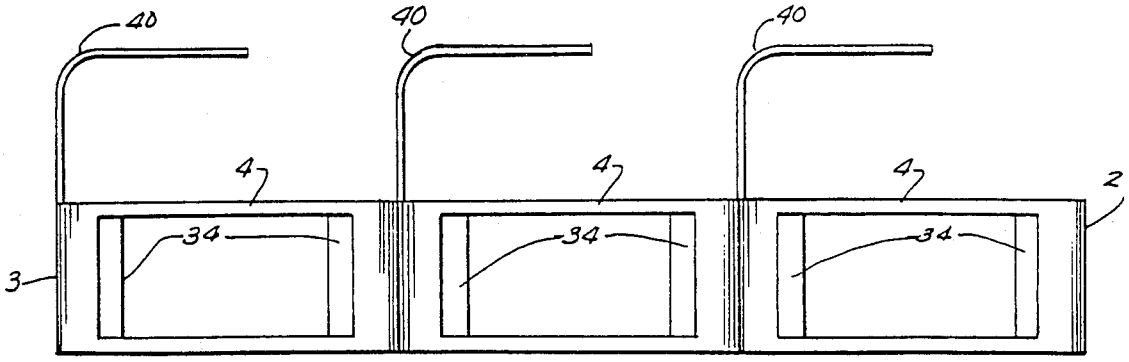
FIG. 10 is a top plan view of three space partition modules, shown in a slightly reduced scale, and arranged in an aligned configuration.
Figure 11:
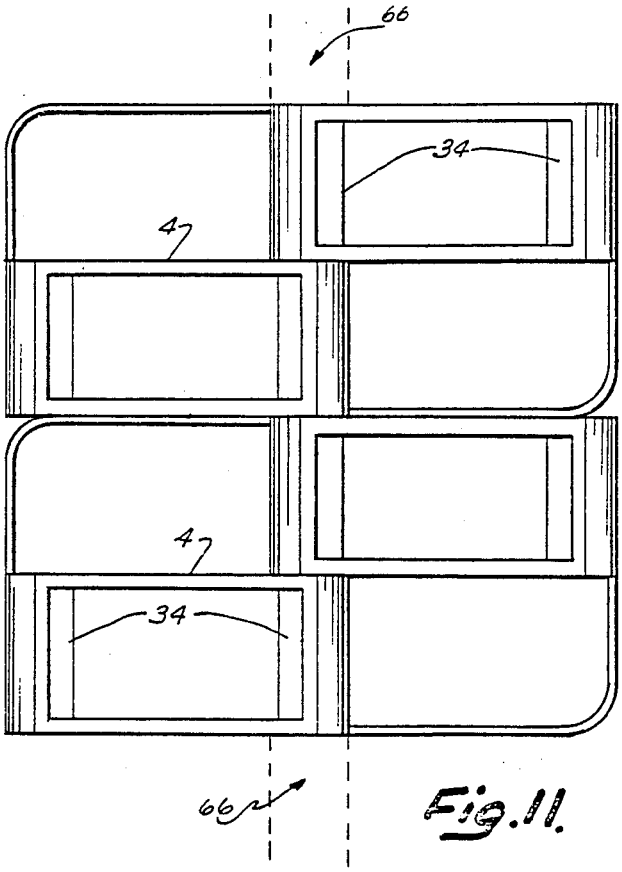
FIG. 11 is a top plan view of four space partition modules, shown in a slightly reduced scale, and arranged in a mutually overlapping configuration.
Figure 12:
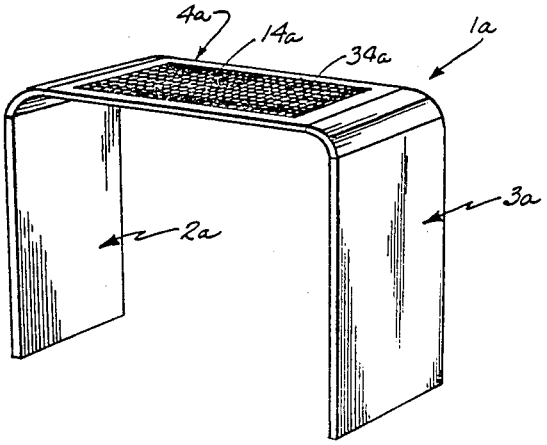
FIG. 12 is a perspective view of another embodiment of the present invention.
Figure 13:
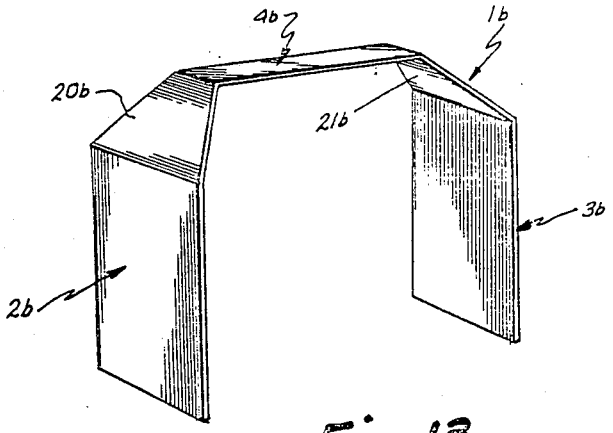
FIG. 13 is a perspective view of yet another embodiment of the present invention.
Figure 14:
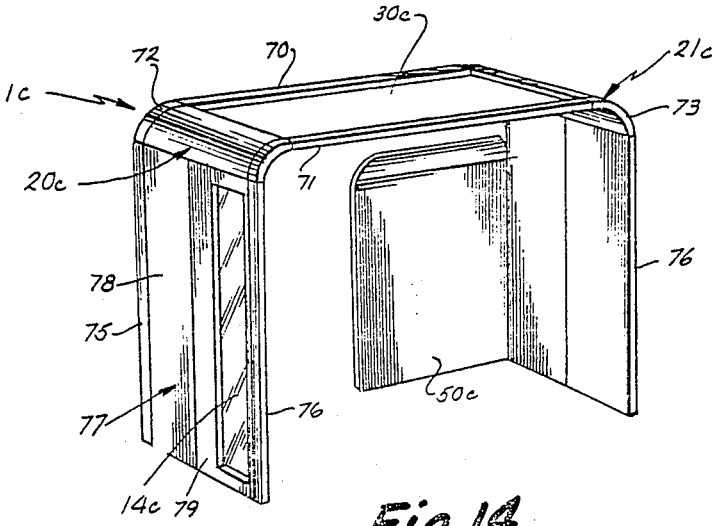
FIG. 14 is a perspective view of yet another embodiment of the present invention.
Figure 15:
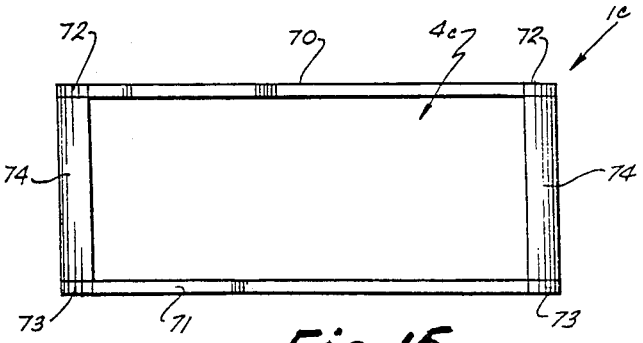
FIG. 15 is a top plan view of the space partition module shown in FIG. 14.

With reference to FIGS. 8–11, a plurality of office modules 1 can be arranged in various configurations to achieve an integrated, overall office plan or scheme, and maximize efficient use of floor space. As shown in FIG. 9, office modules 1 can be arranged so as to create a common, private area 65, which can be used for conferences, library facilities, secretarial services, or the like. FIG. 11 shows four office modules 1 in a laterally staggered, or overlapping configuration, which creates an inner corridor or hallway 66.

The reference numeral 1*a* (FIG. 12) designates another embodiment of the present invention. Since office module 1*a* is similar to the previously described office module 1, similar parts appearing in FIGS. 1–11 and 12 respectively are represented by the same, corresponding reference numeral, except for the suffix "a" in the numerals of the latter. Office module 1*a* does not include separate cove panels, a reception area panel, or a privacy panel, but is otherwise identical to the previously described office module 1.

The reference numeral 1*b* (FIG. 13) designates yet another embodiment of the present invention. Since office module 1*b* is similar to the previously described office module 1, similar parts appearing in FIGS. 1–11 and 13 respectively are represented by the same, corresponding reference numeral, except for the suffix "b" in the numerals of the latter. In office module 1*b*, cove panels 20*b* and 21*b* are generally trapezoidal in shape, and ceiling panel 4*b* does not include a window.

The reference numeral 1*c* (FIGS. 14–18) designates yet another embodiment of the present invention. Since office module 1*c* is similar to the previously described office module 1, similar parts appearing in FIGS. 1–11 and 14–18 respectively are represented by the same, corresponding reference numeral, except for the suffix "c" in the numerals of the latter. In office module 1*c*, ceiling 4*c* comprises a pair of straight, horizontally oriented posts or struts 70 and 71, which have their ends connected with the upper side edges of cove panels 20*c* and 21*c*. Window 30*c* has a rectangular plan shape, and is formed between the inside edges of studs 70 and 71, and the upper edges of cove panels 20*c* and 21*c*. Hence, unlike ceiling panel 4, which forms a rectangular frame about the entire perimeter of window 30, struts 70 and 71 form only the sides of window 30*c*. Struts 70 and 71 are straight and rigid, and laterally interconnect sidewall panels 2*c* and 3*c*. Struts 70 and 71 are straight and rigid, and laterally interconnect sidewall panels 2*c* and 3*c* to support the same in a freestanding or self-supporting condition, as does ceiling panel 4 in office module 1. Preferably, struts 70 and 71 are tubular, with a hollow interior to form enclosed channels or ducts through which utilities may be provided to office module 1*c*. In the office module 1*c* illustrated in FIGS. 14–18, struts 70 and 71 have a rectangular lateral cross-sectional shape, and in one particular example, have a length of approximately 88 inches, a width in the nature of 3 to 4 inches, and a thickness of approximately 2–3 inches.

Unlike the one-piece cove panels 20 and 21 of office module 1, the cove panels 20*c* and 21*c* of office module 1*c* have a three-piece construction, comprising a pair of curved frame sections 72 and 73, and a center panel 74 connected therebetween. Cove frame sections 72 and 73 preferably have a hollow, tubular construction that is similar in lateral cross-sectional shape to that of struts 70 and 71, so that these members interconnect in a telescoping fashion, and form continuous utility ducts along both the front and the rear of office module 1*c*. Center panel 74 is preferably detachably connected with the interior side edges of cove frame sections 72 and 73, and the upper edges 12 of sidewall panels 2 and 3 by suitable fasteners, such as screws, clips, or the like, so that center panel 74 can be removed from office module 1*c*, as illustrated in FIGS. 16–18.

In contrast to the one-piece construction of the sidewall panels 2 and 3 of office module 1, the sidewall panels 2*c* and 3*c* of office module 1*c*, as illustrated in FIGS. 14–18, have a four-piece construction, comprising a pair of straight vertically oriented frame sections 75 and 76, and a two-piece center panel 77 connected therebetween. Sidewall frame sections 75 and 76 preferably have a hollow, tubular construction which is similar in lateral cross-sectional shape to that of both struts 70 and 71, and cove frame sections 72 and 73, so that these members are interconnected in a telescoping fashion, and form two continuous utility ducts along both the front and the rear of office module 1*c*. In the fully assembled condition, struts 70 and 71, in conjunction with cove frame sections 72 and 73 and sidewall frame sections 75 and 76 form two, rigid arches at the front and rear of office module 1*c*, which define the structural skeleton of the office module.

Sidewall center panel 77 comprises a pair of rectangular panels 78 and 79 positioned side-by-side, having their adjacent, inner edge 80 pivotally interconnected by a hinge, or the like, and their opposite, outer edges pivotally connected with an adjacent one of the sidewall frame sections 75 and 76 by a hinge, or other similar device. The hinged connection of sidewall panels 78 and 79 to the sidewall frame sections 75 and 76, and to each other, allows sidewall panels 78 and 79 to fold inwardly, as illustrated in FIGS. 17 and 18.

Figure 16:
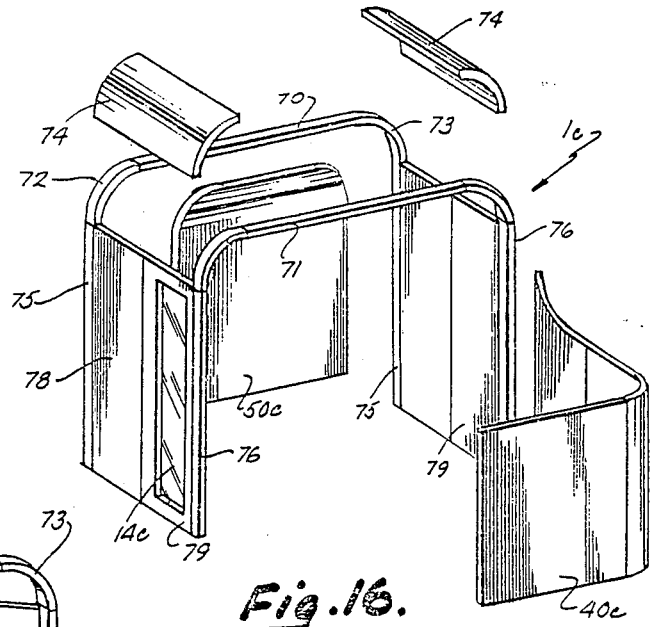
FIG. 16 is an exploded, perspective view of the space partition module shown in FIG. 14.
Figure 17:
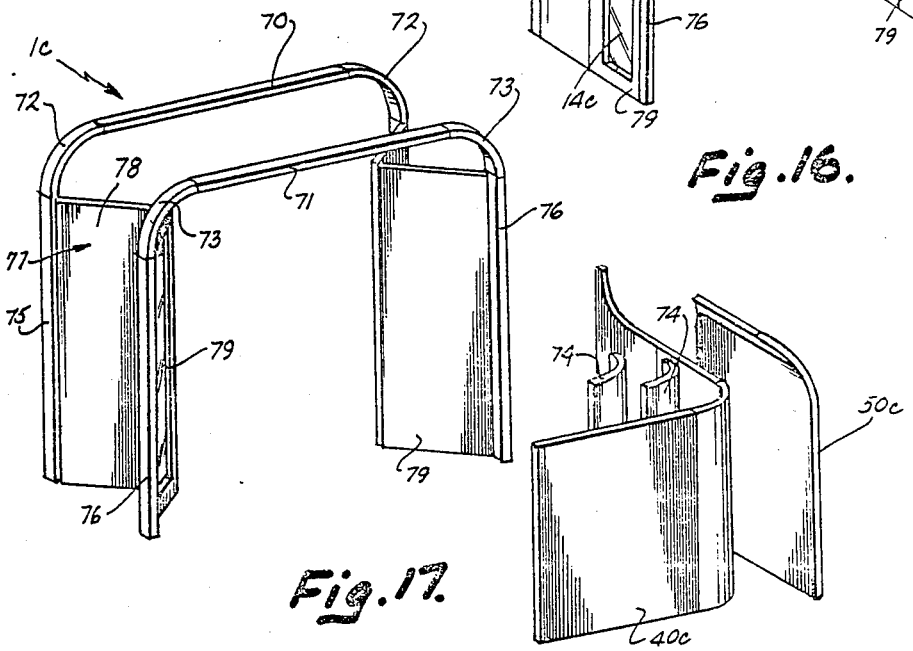
FIG. 17 is a perspective view of the space partition module shown in FIG. 14, illustrated in a disassembled and partially folded condition.
Figure 18:
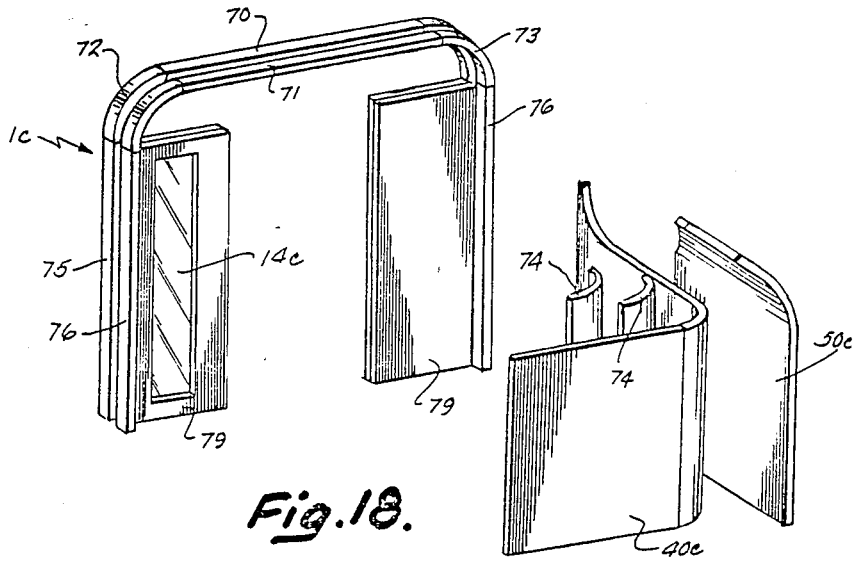
FIG. 18 is a perspective view of the space partition module shown in FIG. 14, illustrated in a disassembled and fully folded condition.

As best illustrated in FIGS. 16–18, the privacy panel 50*c* and reception area panel 40*c* of office module 1*c* are also detachably connected to the office module, so that they can be readily removed for storage and/or transport. To fully collapse office module 1*c*, cove center panels 74, privacy panel 50*c*, and reception area panel 40*c* are first detached and removed from office module 1c, as shown in FIG. 16. The two sidewall center panels 78 and 79 are then rotated inwardly, along their adjacent inner edges, as shown in FIG. 17, until office module 1c assumes the fully folded condition illustrated in FIG. 18.

Office module 1, 1a, 1b and 1c all provide a unique, space partition module that creates private, three-dimensional work stations within an open office space. Each office module personalizes the work station, and provides the worker with the sensation of having his or her very own private room, even within extremely large open office plans. Each office module includes a private area in which work can be performed efficiently and without distractions, as well as open areas to avoid evoking a sense of claustrophobia. The office module is aesthetically pleasing, and can be arranged in many different manners to achieve a particular office configuration.

The reference numeral 1d (FIGS. 19–22) designates yet another embodiment of the present invention. Since space partition arrangement 1d is similar to the previously described space partition arrangement 1, similar parts appearing in FIGS. 1–11 and 19–22 respectively are represented by the same, corresponding reference numeral, except for the suffix "d" in the numerals of the latter. In FIGS. 19–22, space partition arrangement 1d is in the form of a covered entryway. In the example illustrated in FIGS. 19 and 21, covered entryway 1d is incorporated into a panel system 85, which as best illustrated in FIG. 21, includes interconnected straight panels 86 and curved panels 87. The forward side edges 10d (FIG. 19) of sidewall panels 2d and 3d are aligned with the innermost side edges of curved panels 87, so as to form a smooth continuous surface. The height of sidewall panels 2d and 3d is substantially identical to the height of straight panels 86 and curved panels 87, so as to completely integrate covered entryway 1d with panel system 85.

The appearance and construction of ceiling panel 4d (FIGS. 19 and 20) of covered entryway 1d is somewhat different than the ceiling panel 4 of office module 1, although their function is similar. Ceiling panel 4d comprises a pair of cylindrically shaped rods 88, which are connected with and extend between the ends 24d and 25d of cove panels 20d and 21d. Ceiling rods 88 are mutually parallel, and spaced slightly inwardly from the side edges 22d and 23d of cove panels 20d and 21d. A corrugated light diffuser panel 89 extends between the ends 24d and 25d of cove panels 20d and 21d, and is supported on rods 88, with rods 88 extending through a series of aligned apertures in the angled web portions of panel 89. In the illustrated example, light diffuser panel 89 is constructed from a relatively clear, synthetic resin material.

Figure 19:
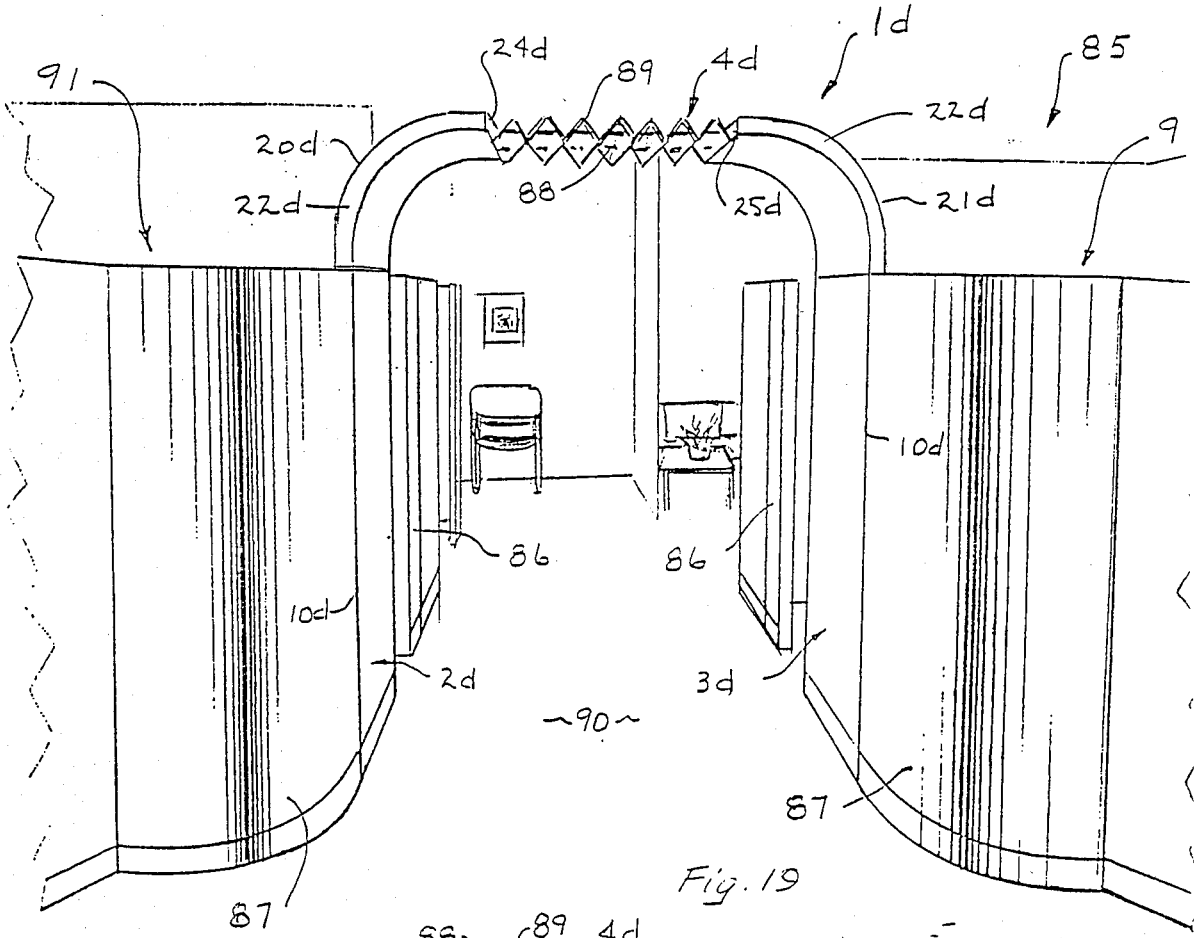
FIG. 19 is a perspective view of yet another embodiment of the present invention, particularly showing a covered entryway.

When arranged in the manner illustrated in FIG. 19, the adjacent interior surfaces of sidewall panels 2d and 3d face each other, and define an aisle 90 therebetween that provides ingress and egress to adjacent work stations 91 and 92. In the example illustrated in FIGS. 19 and 21, aisle 90 continues beyond covered entryway 1d, and is further defined between adjacent straight panels 86.

Figure 20:
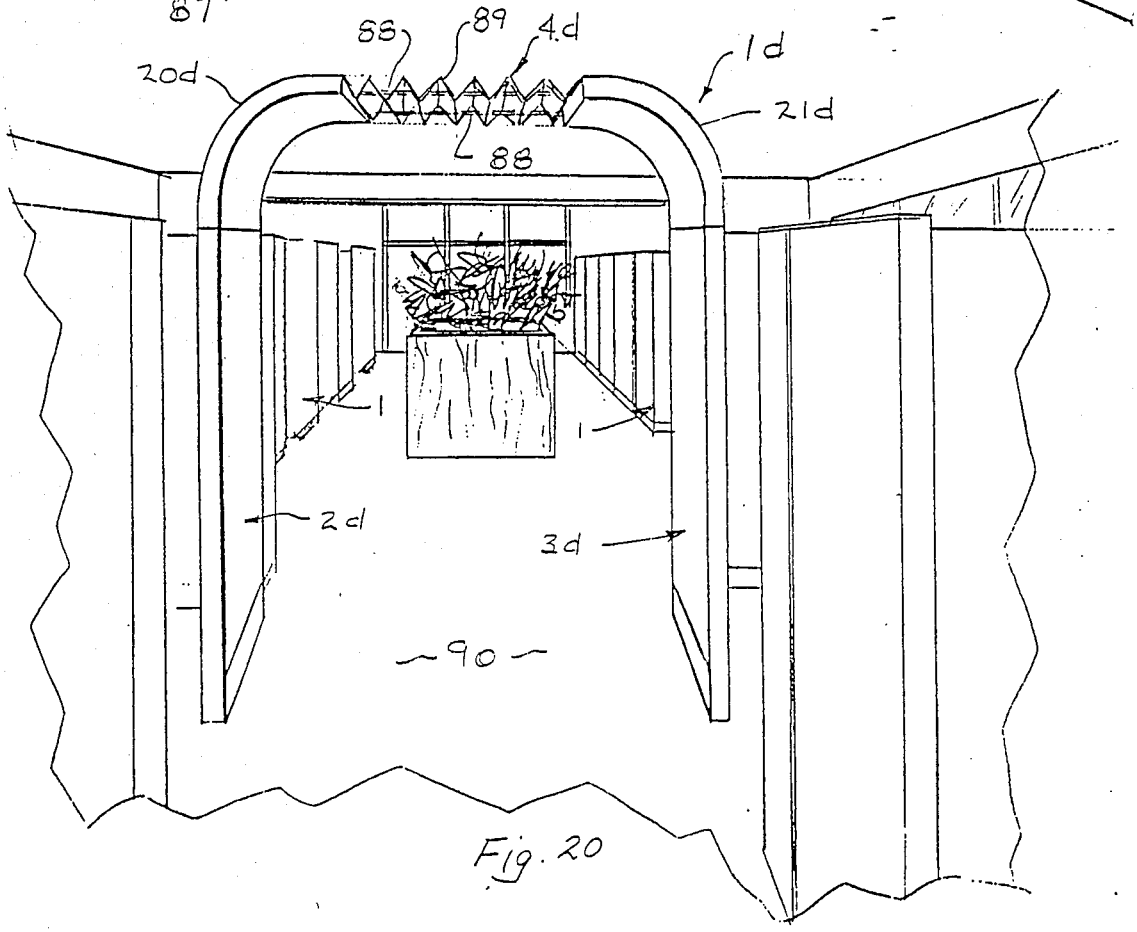
FIG. 20 is a perspective view of another embodiment of the covered entryway illustrated in FIG. 19.
Figure 21:
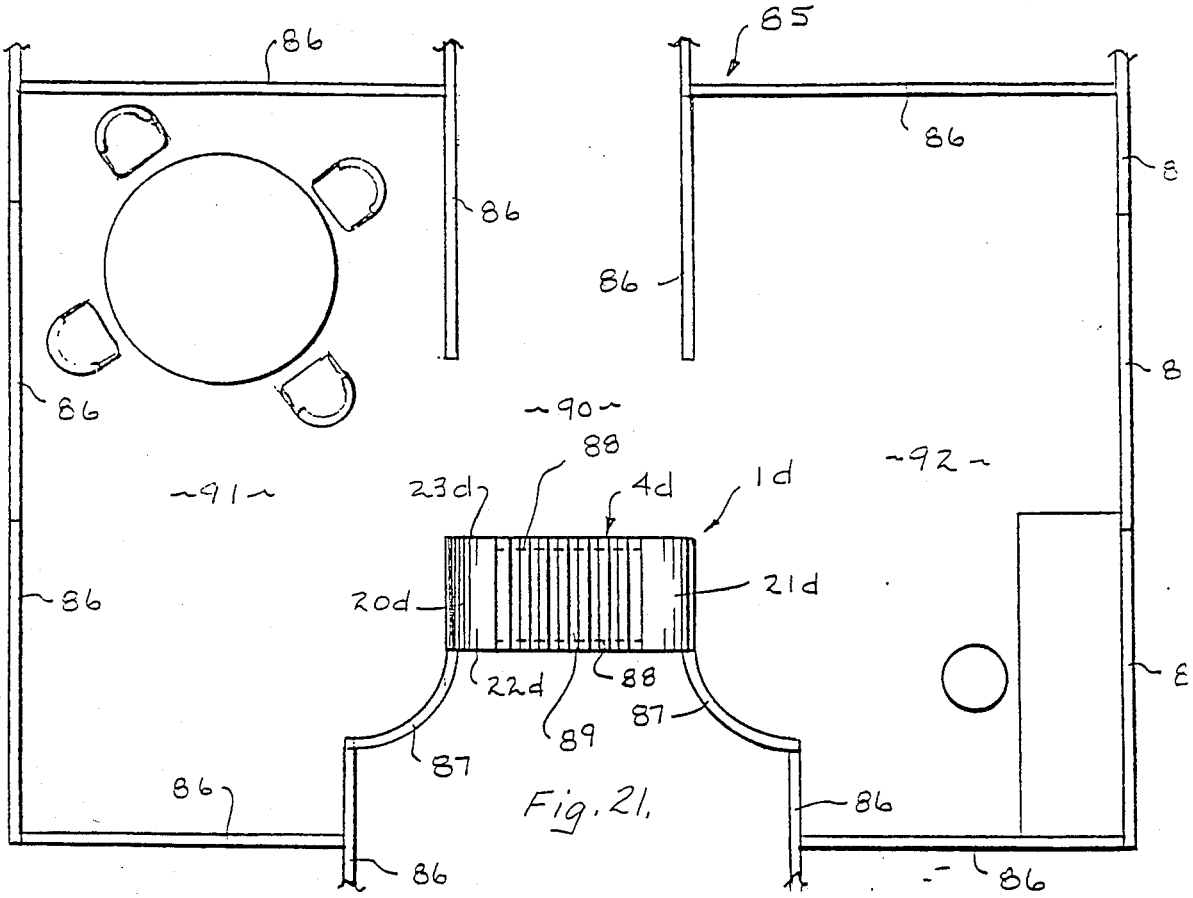
FIG. 21 is fragmentary, top plan view of the covered entryway illustrated in FIG. 19.
Figure 22:
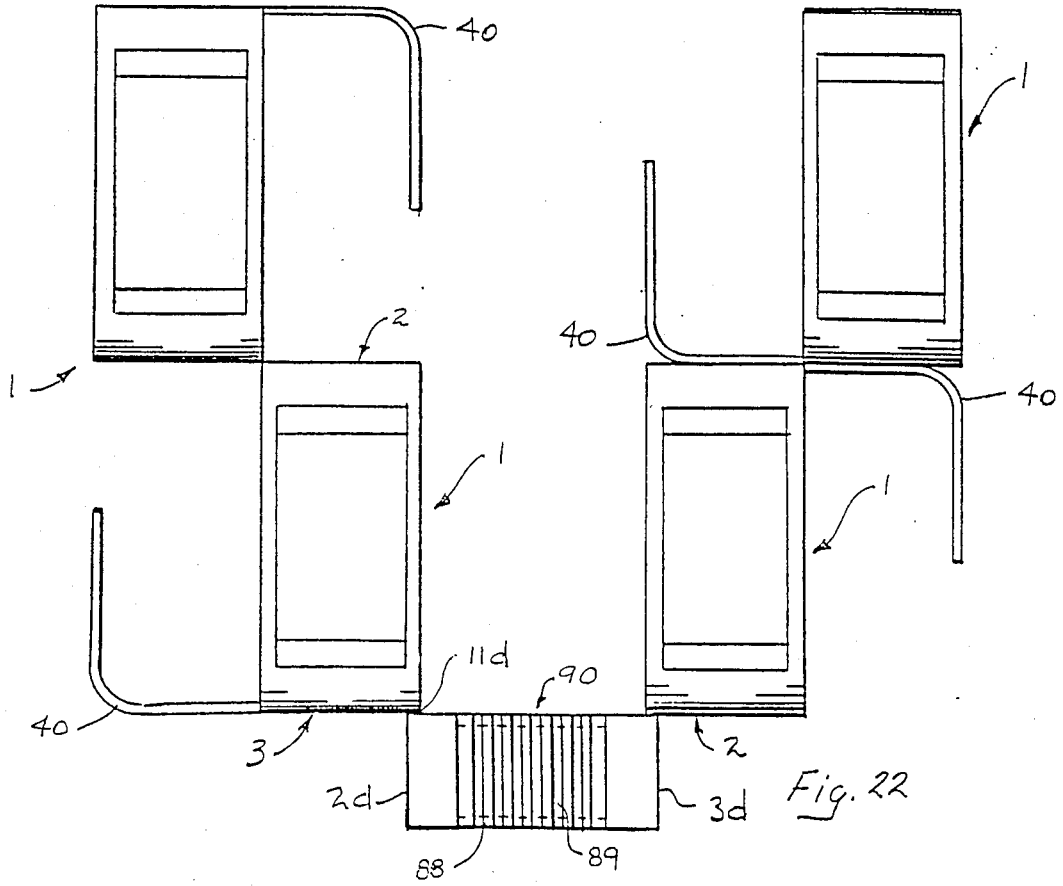
FIG. 22 is a fragmentary, top plain view of another embodiment of the present invention, incorporating the covered entryway illustrated in FIG. 19.

In the example illustrated in FIGS. 20 and 22, covered entryway 1d is integrated with a office module system, comprising a plurality of interconnected office modules 1 with outrigger panels 40, identical to those illustrated in FIGS. 8–11. The rear side edges 11d of sidewall panels 2d and 3d on covered archway 1d abut the sidewall panels 2 and 3 of adjacent office modules 1, and are aligned with the interior edges thereof. The sidewall panels 2d and 3d of covered entryway 1d extend outwardly from the sidewall panels 2 and 3 of office modules 1, and thereby define the initial portion of aisle 90. With the exception of its placement in the panel system, the covered entryway 1d shown in FIGS. 20 and 22 is identical to the covered entryway 1d illustrated in FIGS. 19 and 21.

In the foregoing description, it will be readily appreciated by those skilled in the art that modifications may be made to the invention, without departing from the concepts disclosed herein. Such modifications are to be considered as included in the following claims, unless these claims by their language expressly state otherwise.

The embodiments of the invention in which an exclusive property or privilege is claimed are defined as follows:

1. A space partition arrangement for subdividing an open office space in a building envelope, which is defined by a building ceiling, a building floor having a predetermined area and perimeter, and fixed building walls having a predetermined height; said space partition arrangement comprising:

first and second sidewall panels positioned in a generally vertical, oppositely facing orientation; said first and second sidewall panels having upper edges, lower edges, and said edges, with said lower edges extending along the building floor;

means for supporting said first and second sidewall panels in a generally parallel, spaced apart condition;

a ceiling having opposite end edges operably connected with the upper edges of said first and second sidewall panels, and spanning said first and second sidewall panels without any intermediate support; said ceiling being supported by said first and second sidewall panels at a height above the building floor that is less than the height of the building walls, and said first and second sidewall panels being spaced apart and arranged in a manner that defines an interior area and a perimeter which are substantially less than the area and the perimeter of the open office space in the building envelope, whereby said space partition arrangement can be freely positioned on the building floor at any desired location; and wherein said ceiling includes a pair of cove panels having opposite edges thereof connected with the upper edges of said first and second sidewalls panels, and being inclined upwardly and inwardly toward each other; and said ceiling forms a canopy with sufficient headroom to accommodate average standing users, which canopy, in conjunction with said first and second sidewall panels, defines an unobstructed, three-dimensional area within and independent of the open office space.

2. A space partition arrangement as set forth in claim 1, wherein:

said ceiling includes a pair of cove panels having opposite edges there of connected with the upper edges of said first and second sidewall panels, and being inclined upwardly and inwardly toward each other.

3. A space partition arrangement as set forth in claim 1, wherein:

said cove panels have a generally arcuate end elevational shape.

4. A space partition arrangement as set forth in claim 3, wherein:

said ceiling includes a light diffuser panel disposed between said cove panels.

5. A space partition arrangement as set forth in claim 4, wherein:

said lower edges of said first and second sidewall panels abut the floor of the open office, and at least partially support said space partition arrangement thereon.

6. A space partition arrangement as set forth in claim 5, wherein:

said ceiling includes first and second rigid struts having opposite ends thereof connected with opposite sides of said cove panels.

7. A space partition arrangement as set forth in claim 6, wherein:

said space partition arrangement has a modular construction to facilitate interconnecting a plurality of said space partition arrangements in a predetermined configuration to form a coordinated work area.

8. A space partition arrangement as set forth in claim 7, wherein:

said first and second sidewall panels and said cove panels each have an acoustical interior side for noise abatement.

9. A space partition arrangement as set forth in claim 8, wherein:

said ceiling is positioned to define an arch-shaped entryway.

10. A space partition arrangement as set forth in claim 9, wherein:

said first and second sidewall panels include interior surfaces that face each other and are positioned to define an aisle therebetween, and exterior surfaces that face away from each other and are positioned to define portions of two separate workstations.

11. A space partition arrangement as set forth in claim 1, wherein:

said ceiling includes a light diffuser panel.

12. A space partition arrangement as set forth in claim 1, wherein:

said lower edges of said first and second sidewall panels abut the floor of the open office, and at least partially support said space partition arrangement thereon.

13. A space partition arrangement as set forth in claim 1, wherein:

said ceiling includes first and second rigid struts having opposite ends thereof connected with opposite sides of said first and second sidewall panels.

14. A space partition arrangement as set forth in claim 1, wherein:

said space partition arrangement has a modular construction to facilitate interconnecting a plurality of said space partition arrangements in a predetermined configuration to form a coordinated work area.

15. A space partition arrangement as set forth in claim 1, wherein:

said first and second sidewall panels each have an acoustical interior side for noise abatement.

16. A space partition arrangement as set forth in claim 1, wherein:

said ceiling is positioned to define an arch-shaped entryway.

17. A space partition arrangement as set forth in claim 1, wherein:

said first and second sidewall panels include interior surfaces that face each other and are positioned to define an aisle therebetween, and exterior surfaces that face away from each other and are positioned to define portions of two separate workstations.

* * * * *

UNITED STATES PATENT AND TRADEMARK OFFICE

CERTIFICATE OF CORRECTION

PATENT NO. : 4,856,242

DATED : August 15, 1989

INVENTOR(S) : Mark A. Baloga

It is certified that error appears in the above-identified patent and that said Letters Patent is hereby corrected as shown below:

Column 7, line 25:

"ad" should be --and--;

Column 9, line 64:

"a" should be --an--;

Column 10, claim 1, line 28:

"said" (first occurrence) should be --side--;

Column 10, lines 60-66:

delete "claim 2 in its entirety."

Signed and Sealed this

Twenty-second Day of January, 1991

*Attest:*

HARRY F. MANBECK, JR.

*Attesting Officer*

*Commissioner of Patents and Trademarks*